US008220538B2

(12) United States Patent
Wee

(10) Patent No.: US 8,220,538 B2
(45) Date of Patent: Jul. 17, 2012

(54) PLUG

(76) Inventor: Gustav Wee, Forresfjorden (NO)

( * ) Notice: Subject to any disclaimer, the term of this patent is extended or adjusted under 35 U.S.C. 154(b) by 0 days.

(21) Appl. No.: 13/145,428

(22) PCT Filed: Feb. 3, 2010

(86) PCT No.: PCT/NO2010/000041
§ 371 (c)(1),
(2), (4) Date: Jul. 20, 2011

(87) PCT Pub. No.: WO2010/090529
PCT Pub. Date: Aug. 12, 2010

(65) Prior Publication Data

US 2011/0277988 A1 Nov. 17, 2011

(30) Foreign Application Priority Data

Feb. 3, 2009 (NO) ..... 20090520

(51) Int. Cl.
*E21B 33/12* (2006.01)

(52) U.S. Cl. ... 166/179; 166/187; 166/145; 166/250.17; 166/387

(58) Field of Classification Search ..... 166/179, 166/187, 145, 250.17, 387
See application file for complete search history.

(56) References Cited

U.S. PATENT DOCUMENTS 2,756,828 A * 7/1956 Deily ..... 166/147
4,544,034 A * 10/1985 George ..... 166/297
4,886,127 A 12/1989 Ricles et al.
5,479,986 A 1/1996 Gano et al.
5,607,017 A 3/1997 Owens et al.
5,632,348 A 5/1997 Yunan
5,680,905 A 10/1997 Green et al.
5,765,641 A 6/1998 Shy et al.
6,076,600 A 6/2000 Vick, Jr. et al.
6,161,622 A 12/2000 Robb et al.
6,220,350 B1 4/2001 Brothers et al.
6,431,276 B1 8/2002 Robb et al.
(Continued)

FOREIGN PATENT DOCUMENTS

GB 2437657 A 10/2007
(Continued)

OTHER PUBLICATIONS

Ott, Stéphane, "International Search Report" for PCT/NO2010/000041 as mailed Sep. 1, 2010, 3 pages.

*Primary Examiner* — William P Neuder
*Assistant Examiner* — Yong-Suk Ro
(74) *Attorney, Agent, or Firm* — Winstead PC

(57) ABSTRACT

A plug for installation in a well is described, which comprises a housing (1) that carries at least two discs (5, 6) made from a brittle material which can be crushed with mechanical stress. Between at least two of the discs (5, 6) is a gas-filled cavity (15) that is in connection with a drainage channel (14) and a closing device (16) which is set up to open to release the gas from the cavity (15). Arranged in the cavity is at least one break bar 7 or a break bushing (8-12) that is set up to crush at least one of the discs (5, 6). Also arranged is a shear pin (13) that holds the discs (5, 6) apart, but which is set up to be broken when the pressure difference across at least one of the discs (5, 6) exceeds a given value.

9 Claims, 1 Drawing Sheet

U.S. PATENT DOCUMENTS

| | | | |
|---|---|---|---|
| 6,472,068 | B1 | 10/2002 | Glass et al. |
| 7,044,230 | B2 | 5/2006 | Starr et al. |
| 7,093,664 | B2 | 8/2006 | Todd et al. |
| 7,168,494 | B2 | 1/2007 | Starr et al. |
| 7,325,617 | B2 | 2/2008 | Murray |
| 2002/0108750 | A1 | 8/2002 | Friend et al. |
| 2003/0168214 | A1 | 9/2003 | Sollesnes |
| 2007/0017676 | A1 | 1/2007 | Reddy et al. |

FOREIGN PATENT DOCUMENTS

| | | | |
|---|---|---|---|
| NO | 321974 | B1 | 7/2006 |
| NO | 321976 | B1 | 7/2006 |
| NO | 322871 | B1 | 12/2006 |
| NO | 325431 | B1 | 4/2008 |
| WO | WO-2007108701 | A1 | 9/2007 |
| WO | WO-2008/127126 | A2 | 10/2008 |

* cited by examiner

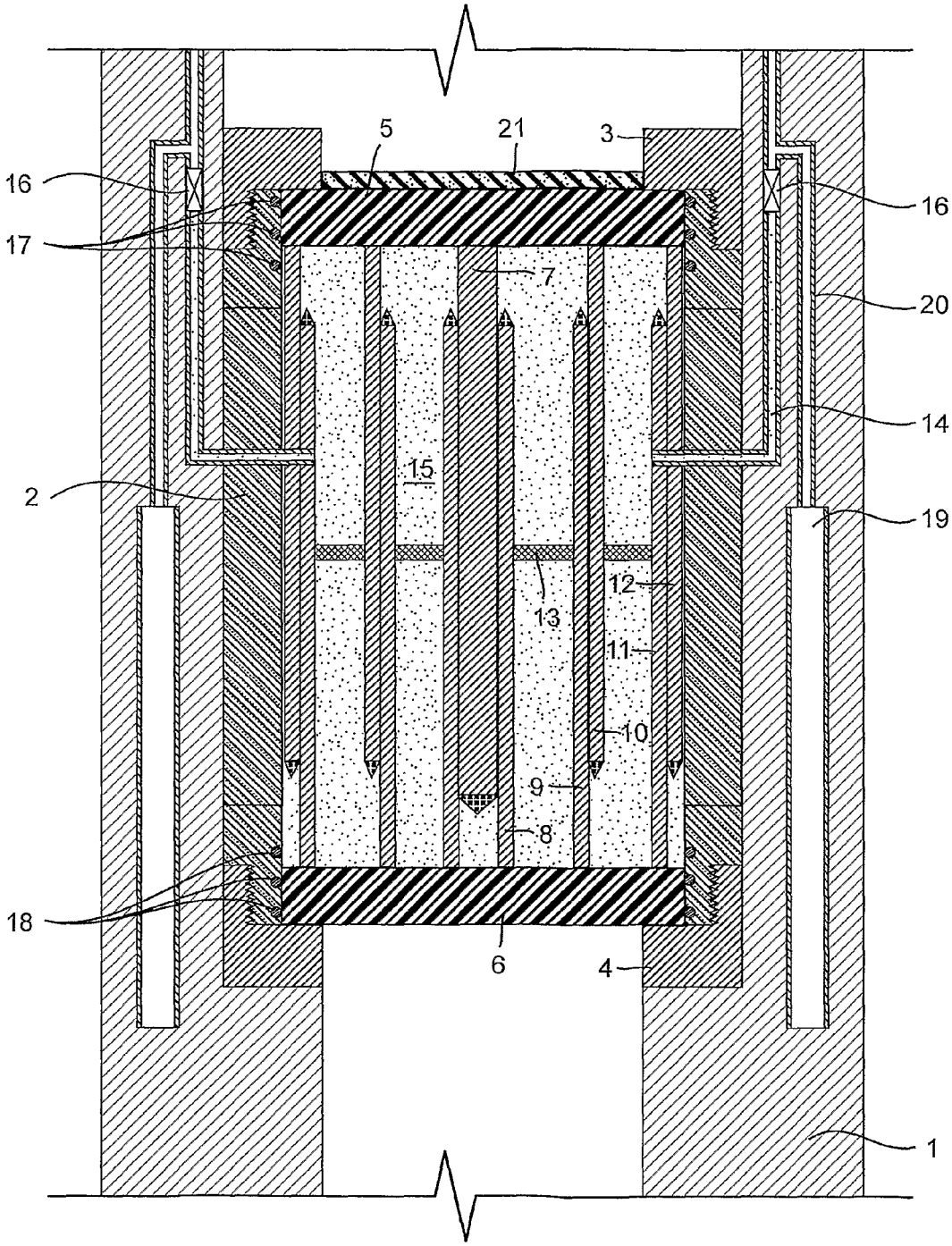
5
21
3
16
16
17
7
20
14
15
2
19
12
13
11
10
9
8
18
6
4
1

PLUG

The present invention relates to a plug for temporary installation in a well, particularly for use in pressure testing of the well, as described in the preamble of the following claim 1.

This type of plug is typically installed when a well shall be pressure tested, for example, before production from the well is started up or after comprehensive maintenance of the well has been carried out. When the plug is installed, it is possible to put pressure on a part of the well and check that the valves, pipe joints, gaskets, etc. do not leak. After the pressure testing is completed and production is about to start, the plug must be removed. It can be difficult or often impossible to bring the plug up to the surface again, and plugs have therefore been developed that can be destroyed after they have served their usefulness. The remains of the plug are then brought out of the well with the well stream. Today, there are several types of plugs that are intended to be removed by being destroyed. In the 1980's a plug that could be destroyed was developed in Egypt. This was installed in more than 800 wells.

The known destructible plugs can be destroyed in several ways. Some types of plugs will dissolve after a certain time in contact with the well fluid, while others are destroyed by means of explosives. The latter plugs are usually made of glass, and examples of these are shown in NO 321974, NO 322871 and NO 321976.

Also known is a plug from NO 325431, where the plug is destroyed by a valve that is set to drain fluid from between glass discs. When the pressure between the glass discs is reduced, the glass discs will not withstand the pressure on the upper side of the plug and thereby break up.

Other plugs that can be destroyed are different types known from U.S. Pat. No. 4,886,127, U.S. Pat. No. 5,607,017, U.S. Pat. No. 5,479,986, U.S. Pat. No. 5,607,017, U.S. Pat. No. 5,765,641, U.S. Pat. No. 5,632,348, U.S. Pat. No. 5,680,905, U.S. Pat. No. 6,076,600, U.S. Pat. No. 6,161,622, U.S. Pat. No. 6,431,276, U.S. Pat. No. 6,220,350, U.S. Pat. No. 6,472,068, U.S. Pat. No. 7,044,230, U.S. Pat. No. 7,093,664, U.S. Pat. No. 7,168,494, U.S. Pat. No. 7,325,617, US 2003/0168214 and US 2007/0017676.

The known plugs all have different disadvantages. The plugs that dissolve will first disappear after the well fluid has been working a while on the soluble material. It is therefore not possible to predict accurately when the plug will stop to seal properly. This can at best delay the starting up of the production and in the worst case the plug can lose its function prior to the pressure testing being completed. To avoid the latter, the plug will usually be designed so that it takes a relatively long time before it is dissolved.

Plugs that are destroyed with the help of explosives will usually be destroyed securely and at the time you want. However, they are associated with risks. As the explosives must be handled carefully, special shipment of these is required and it can be very difficult to get the plugs sent across national borders, especially to areas with strict control of weapons and explosives. Furthermore, personnel with special knowledge of explosives are required for the handling of the plugs. Although the risk is small, there will be a certain danger that the explosives go off and hurt people and put the production installation at risk. In rare cases, there can be a risk of the explosives damaging equipment down in the well.

The above mentioned plug known from NO 325431 aims to avoid the use of explosives. As mentioned above, the destruction occurs in that the pressure inside the plug is relieved by means of a valve body so that the pressure difference between the external pressure (on the top side of the plug) and the internal pressure becomes greater than the glass discs of the plug can withstand. The glass discs break up successively.

Although it also mentioned that the discs can be subjected to point loads in that bars are arranged which are set up to be pushed against the edge of the glass discs when the valve body is opened, it will require a relatively high pressure across the plug to ensure that the glass discs break up. How high this pressure must be will vary and one must therefore increase the pressure across the plug until one is sure that it is destroyed. This pressure increase will take some time and after the plug is destroyed, the pressure wave will propagate down in the well and potentially be able to damage the formation.

If the liquid between the glass discs should not be drained out, for example, as a consequence of it being impossible to open the valve body, the plug will not be destroyed although pressure across the plug is increased to a very high level. Then, one must go down with tools or explosives to destroy it.

It is also possible that the glass discs will not dissolve into small pieces, but will leave large chunks which can be difficult to get out with the well stream.

The present invention aims for a predictable, secure and accurate destruction of the plug while the plug is safe to handle prior to the installation. This is achieved by the features described in the characterising part of the subsequent claim 1.

By filling the cavity between the discs with gas, it will be possible to relieve the pressure between the discs quickly and the pressure difference between the top side and the bottom side of the upper discs will be established much faster than with the use of liquid between the discs.

The plug according to the present invention shall now be explained in more detail with the help of an embodiment example shown in the single FIGURE of the application.

The plug comprises a housing 1, which is formed at each end for connecting with a pipe so that the plug can be inserted as a middle piece in a production pipe. Inside the housing is a sleeve 2 that is fitted at both ends with a locking ring, an upper locking ring 3 and a lower locking ring 4, respectively. The sleeve 2 carries two discs, an upper disc 5 and a lower disc 6 that are held in place within the sleeve 2 by means of the locking rings 3, 4.

The discs 5, 6 are made from a brittle material so that the discs can be crushed with mechanical stress. The material can, for example, be glass, ceramic glass, pottery, sandstone, stone, plaster, composite, composite mix, epoxy, and porcelain.

On the sides facing each other, the discs are fitted with break bars and break sleeves and from the inside and out these are as follows: a main bar 7 attached to the upper disc 5, a first break bushing 8, which is attached to the lower disc 6 and surrounds the bar 7, a second break bushing 9, which is attached to the lower disc 6 and is arranged concentrically with, but a distance away from the first break bushing 8, a third break bushing 10, which is attached to the upper disc 5 and surrounds the second break bushing 9, a fourth break bushing 11, which is attached to the lower disc 6 and is arranged concentrically with, but at a distance from, the third break bushing 10, a fifth break bushing 12, which is attached to the upper disc 5 and surrounds the fourth break bushing 11.

The bar and the bushings can be designed so that they are integrated with respective discs 5, 6, for example in that the disc and lever/bushings are moulded in one piece.

The bar 7 is slightly longer than the break bushings 8-12. Both the bar 7 and the break bushings 8-12 are fitted, at their free end opposite to the disc they are fastened to, with a point or edge of a hard material, for example, diamond or a hard metal.

A shear pin 13 extends approximately midway between the discs 5, 6 and roughly perpendicular to the bar and the break bushings.

A channel 14 extends through the sleeve 2 and the outermost break bushings 11, 12. The channel 14 is, at its one end, in connection with an inner cavity 15 between the discs 5, 6. The channel 14 extends into the housing 1 and is fitted with a gas-proof valve 16. Instead of a valve 16, another type of sealing device can be used, which can be removed to open up the channel 14.

The locking rings 3, 4 are equipped with seals, for example, o-rings 17, 18, which seal against the discs 5, 6. Thus, the cavity 15 is isolated with no gas leaks to the surroundings.

Outside the valve 16, the channel 14 is in communication with an evacuation chamber 19, via an evacuation line 20. The evacuation chamber 19 is most appropriately placed higher up in the well than the plug. Thus, the FIGURE only illustrates schematically how the chamber is connected to the channel 14 and does not indicate the location of it.

There are preferably at least two channels 14 with associated valve 16 and evacuation chamber 19.

A coating of a soft material is placed on the top side of the upper disc 5, for example, silicone, rubber or the like, which protects the disc 5 against falling objects, so that it is not destroyed inadvertently.

Before the plug is to be installed in the well, the cavity 15 is pressurised with, for example, nitrogen via the channel 14. The pressure will be between 50 and 1000 bar according to the choice of material and type of well. Typically, the pressure will however be of the order of 300 bar. The chamber 19 can have atmospheric pressure.

As the discs 5 and 6 are prevented from moving away from each other by the locking rings 3, 4, the plug will be able to withstand an internal pressure of this magnitude. In spite of being manufactured from a very brittle material, the discs will be able to withstand high pressures as long as they are not subjected to mechanical stress. As the discs are designed to be crushed by mechanical stress and not by increased pressure alone, they can be made to withstand a much higher pressure than the plug is subjected to in the well.

The plug is thereafter installed in the well. The shear pin 13 can withstand, for example, 150 bar. Because of the internal pressure of 300 bar and the strength of the shear pin 13 of 150 bar, the plug will be able to withstand a pressure difference between the underside and the top side of up to 450 bar without the shear pin being broken. This is more than sufficient to carry out the necessary well tests.

When the plug has played its part and is to be removed, one first ensures that the pressure on the top side of the plug is above 150 bar. Thereafter, the valve 16 is opened. This can take place in several different ways, for example, by using a remote controlled actuator, a wire-guided tool or a specific sequence of pressure changes that trigger an actuator. The pressure in the cavity 15 is discharged into the chamber 19. Thereby, the pressure in the cavity 15 drops quickly and the pressure difference across the upper disc 5 soon exceeds 150 bar. When this happens, the shear pin 13 snaps and the upper disc is forced down with great force. If the pressure underneath the lower disc 6 also exceeds the pressure in the cavity 15, the lower disc 6 will also be forced upwards. First, the bar 7 hits the lower disc 6 and immediately after this the break bushings 8-12 hit the respective discs 5, 6. When the hard ends and edges, respectively, of the bar 7 and break bushings 8-12 hit the discs, the discs are effectively crushed and are nearly pulverised.

The pressure that is required to break the shear pin is far less than the pressure which alone would have broken the discs 5, 6. However, the discs will not withstand the strong mechanical strain they are subjected to from the bar and the break bushings.

The bar 7 and the break bushings 8-12 will also be crushed in this collision and the pieces of these and the discs may be brought with the well stream out of the well or possibly sink down to the bottom of the well and remain lying there without being a hindrance for the production.

The vacuum chamber 19 can be arranged outside the plug and be connected with this via the channel 20.

The invention claimed is:

1. A plug comprising:

a housing;

at least two discs carried by the housing and of a brittle material that can be destroyed by mechanical stress;

a gas-filled cavity between the at least two discs;

wherein the gas-filled cavity is connected to a drainage channel and a closing device which is set up to open to release gas from the gas-filled cavity;

wherein the gas-filled cavity comprises at least one break bar or at least one break bushing that is set up to crush at least one of the at least two discs;

a shear pin that keeps the at least two discs apart, wherein the shear pin is adapted to be broken when a pressure difference across at least one of the at least two discs exceeds a certain value; and wherein, responsive to the shear pin breaking, a first disc of the at least two discs moves towards a second disc of the at least two discs.

2. The plug according to claim 1, wherein the at least one break bar and the at least one break bushing are arranged with a first end connected to the first disc of the at least two discs and a second end a distance away from the second disc of the at least two discs and wherein the second end is fitted with a point or an edge of a hard material.

3. The plug according to claim 2, wherein:

the first disc is fitted with at least one of break bars and break bushings that extend towards the second disc; and the second disc is fitted with at least one of break bars and break bushings that extend towards the first disc.

4. The plug according to claim 3, wherein the shear pin extends transversely through the fitted at least one of break bars and break bushings and prevents movement thereof toward a disc of the first disc and the second disc.

5. The plug according to claim 3, wherein a first break bar of the at least one break bar is attached centrally to the first disc of the at least two discs, wherein a first break bushing of the at least one break bushing is attached to the second disc and surrounds the first break bar of the at least one break bar.

6. The plug according to claim 5, wherein the at least one break bushing is concentric.

7. The plug according to claim 1, wherein the drainage channel is connected to a vacuum chamber to receive gas that is drained from the gas-filled cavity.

8. The plug according to claim 1, wherein the gas-filled cavity is pressurised with a pressure of between 50 and 1000 bar prior to installation of the plug.

9. The plug according to claim 1, wherein the gas-filled cavity is pressurised with a pressure of an order of 300 bar prior to installation of the plug.

* * * * *